United States Patent [19]

Gana

[11] Patent Number: 4,807,789

[45] Date of Patent: Feb. 28, 1989

[54] TAPE DISPENSER

[76] Inventor: John W. Gana, 5077 Landisville Rd., Doylestown, Pa. 18901

[21] Appl. No.: 946,954

[22] Filed: Dec. 29, 1986

[51] Int. Cl.[4] ..... B65H 35/04

[52] U.S. Cl. ..... 225/16; 225/11; 225/19; 225/91

[58] Field of Search ..... 225/10, 11, 16, 19, 225/91, 92

[56] References Cited

U.S. PATENT DOCUMENTS

| | | | |
|---|---|---|---|
| 2,240,675 | 5/1941 | Selinger | 225/19 |
| 2,593,291 | 4/1952 | Garik | 225/11 X |
| 2,710,063 | 6/1955 | Krueger | 225/16 |
| 3,102,670 | 9/1963 | Krueger | 225/16 X |
| 3,204,949 | 9/1965 | Kieslich | 225/11 X |
| 4,175,685 | 11/1979 | Niles | 225/19 |

*Primary Examiner*—Frank T. Yost

*Attorney, Agent, or Firm*—Joseph W. Molasky & Assocs.

[57] ABSTRACT

A tape dispensing apparatus equipped with improved means for cutting tape into discrete segments. A straight-edged blade vertically disposed and secured within a U-shaped support provides enhanced cutting abilities while protecting the operator from injurious contact with the blade cutting edges.

8 Claims, 2 Drawing Sheets

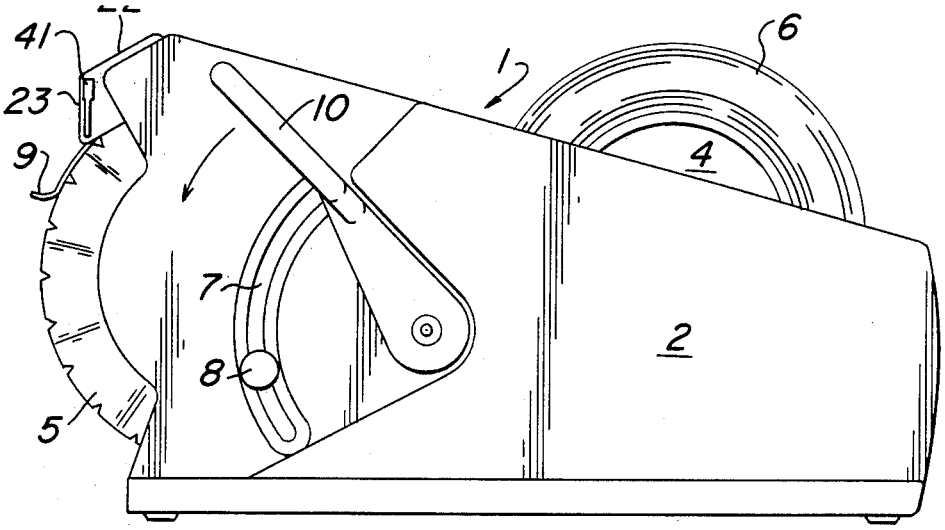
FIG. 1
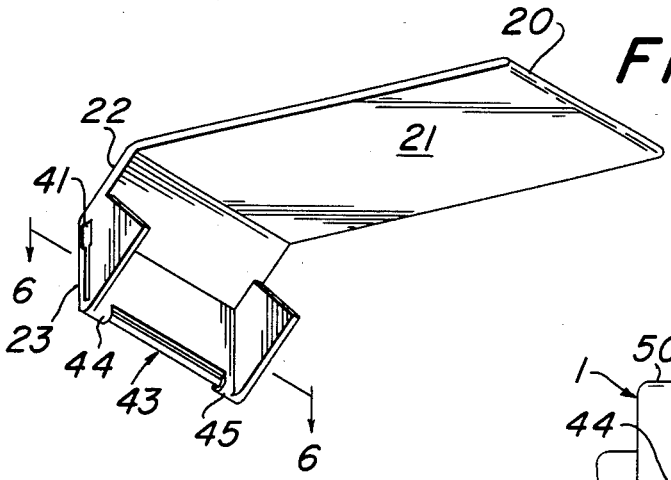
FIG. 2
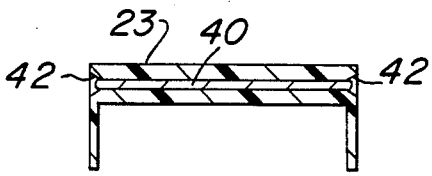
FIG. 6
FIG. 3
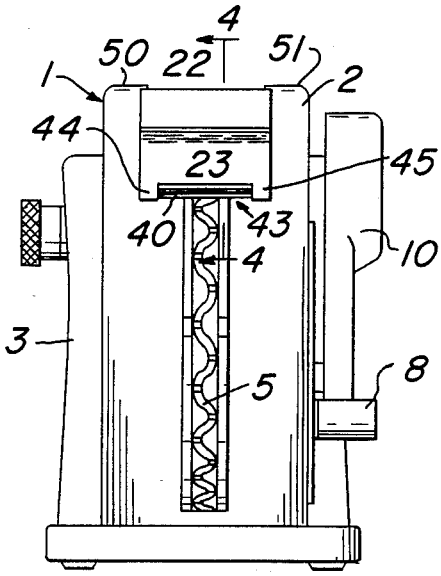

TAPE DISPENSER

This invention relates to an improved apparatus for dispensing and cutting tape segments fed from a definite-length tape dispenser.

Specifically, this invention relates to an apparatus for dispensing and cutting pre-determined lengths of tape by bringing the tape segment into engagement with the cutting edge of a straight-edged blade. The blade is shielded at its terminii or corners by a guard which protects the operator against inadvertent contact.

The present invention is an advance in the art because it allows the operator to safely cut discrete segments of tape from a feed roll in pre-determined lengths in a safe and efficient manner absent the ragged or frayed edges which characterize tape segments which are cut with corrugated blades.

BACKGROUND

A definite-length dispenser is one which provides a pre-determined measure of tape from a tape roll in a single stroke. The dispenser is operated by a lever arm which causes a tape drum to rotate and feed a precise length of tape onto a feeder wheel, whereupon, the tape segment is lifted upwardly from the wheel and brought into cutting engagement with a corrugated blade. In general, the length of the dispensed tape is equal to the distance traveled by said arm.

One difficulty with known dispensers is the prominent display given to the corrugated blade so that the entire cutting edge including the end segments or terminii, are fully exposed. This cutting edge and terminii are a hazard to the operator because the dispensed tape segment must be gripped at one end while pulling upwardly and this operation often brings the thumb and forefinger into injurious contact with the ends of the blade.

Moreover, the corrugated blade design affords an uneven cut which often results in ragged or frayed edges. This condition is particularly damaging when the tape is comprised of reinforcing fiber strands because a corrugated blade will cause the strands to separate and thus weaken the tape segment.

Also, corrugated blades require an appreciable setup time because the blade must be secured by screws between a cover and a blade clamp and the blade must be centered to ensure an effective cut.

Accordingly, there is a need for improvement in tape dispensers equipped with corrugated blades.

THE INVENTION

It is an object of this invention to provide an apparatus having improved means for cutting tape segments from a definite-length tape dispenser.

Another object is to provide a tape dispenser equipped with a straight-edged blade which can be installed easily in a fraction of the time required for an assembly equipped with a corrugated blade.

Still another object is to provide a tape dispensing assembly in which the severing blades are covered at their terminii to protect the operator against inadvertent injurious contact.

A further object provides for a tape dispensing assembly in which the severing operation is performed by a straight-edged blade with less effort than is required with a corrugated blade. Moreover, the blades of this invention are inexpensive and their clean even cut makes it possible to produce tape segments smaller in size than was heretofore possible.

Briefly stated, this invention relates to a tape dispensing apparatus equipped with a novel support means for slidably receiving and securing a straight-edged blade. The blade support consists essentially of a cover assembly which terminates in a vertical support equipped with slotted end openings for receiving the blade. This vertical support is essentially U-shaped and its longitudinal segment includes a recessed cutout which allows only the cutting portion of the blade to remain exposed while protecting the user from inadvertent contact with its terminal ends.

Unlike commercial dispensers which position a corrugated blade at about a 45° angle, the present assembly positions the blade within a vertical support on a plane which intersects the circular path of the tape dispensing wheel. In practice, this apparatus can be equipped with a new cutting edge by simply impressing one of the blade ends into the receiving aperture of the vertical support until it is properly centered, an operation which is facilitated by the presence of bevelled end openings and which can be effected within seconds without the use of screws or other retaining means.

These and other features of the invention will be more clearly understood by reference to the appended Drawings and the Preferred Embodiments which follow.

THE DRAWINGS

FIG. 1 is a side elevational view of the dispensing apparatus of this invention with the cover assembly installed.

FIG. 2 is an underside view of the cover assembly illustrating the blade-holding segment.

FIG. 3 is a front elevational view of the dispensing apparatus shown in FIG. 1.

FIG. 6 is a sectional view of the blade-holding segment shown in FIG. 2 along line 6—6.

Figure 4:
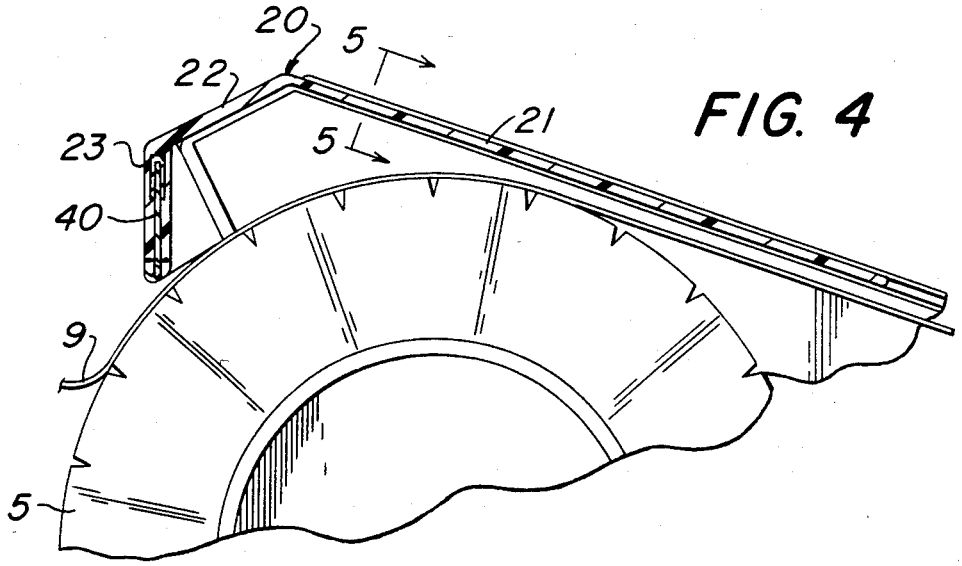
FIG. 4 is a partial sectional view of the dispensing apparatus shown in FIG. 3 along line 4—4.

This invention will now be described by reference to precise embodiments but it is to be understood that the following description is for illustration purposes only and the invention is not to be construed as being limited thereto.

DESCRIPTION OF THE PREFERRED EMBODIMENTS

The dispensing apparatus 1 consists essentially of a right-side frame 2 and a left-side frame 3 which are joined to form a housing in which are disposed a revolving tape drum 4 and a feed wheel 5 of fluted design (FIG. 1). The circumference of tape drum 4 is such that it fits snugly within a tape roll opening so that the combination of said drum and the tape roll 6 can be mounted together within the apparatus as a unit.

The feed wheel 5 is actuated for rotating movement by depressing the lever arm 10 within pathway 7 so as to dispense onto the fluted surface of said wheel a tape segment 9 equal in length to the distance traveled by said lever arm.

Disposed within pathway 7 for slidable engagement is an adjustable knob 8 which can be slidably moved and threadedly secured to provide a stop for the lever arm 10. When knob 8 is secured within said pathway at an elevated position a tape segment of abbreviated length is obtained, whereas, the engagement of said knob at some lower position results in a tape segment of proportionately greater length.

Figure 5:
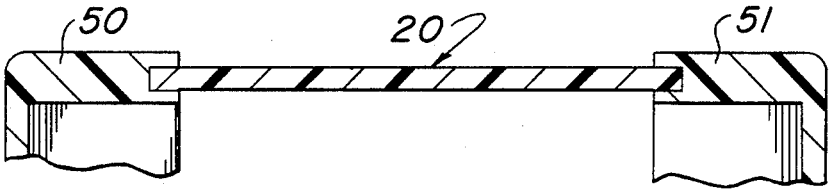
FIG. 5 is a sectional view of the cover assembly in its installed mode taken along line 5—5 of FIG. 4.

Mounted above the feed wheel 5 is a cover assembly 20 which is adapted for sliding engagement within tracks located in housing segments 50 and 51 of the dispensing apparatus (FIGS. 4 and 5). This assembly consists essentially of an elongated flat cowling 21, an angular segment 22 which lies at an angle of 45° with respect to said cowling and a verticaly disposed segment 23 equipped with cavity or aperature means 41 for accommodating a straight-edged blade 40.

The blade is slidingly received by the cavity 41 and held in place by frictional engagement. Bevels 42 on both sides of the cavity opening facilitate blade entry. The blade 40 is equipped on one side with a finger guard and the cutting edge is finely honed to provide evenly cut tape segments which are neither ragged or frayed.

This invention will now be illustrated by reference to the loading and cutting features of the present apparatus.

In practice, the apparatus is loaded by first removing the cover assembly 20 and installing within the housing a tape roll 6 fitted onto an accommodating tape drum 4. This combination of tape drum and tape roll are inserted within the dispenser for rotating movement so that the tape can be dispensed from the top of the roll and pulled forward for impressing same onto the feed wheel 5. The cover assembly 20 is replaced by slidably engaging same within tracks provided by housing segments 50 and 51 and knob 8 is secured within the pathway 7 to provide a stop for the lever arm 10. The securing of knob 8 along an elevated portion of the pathway affords a tape segment of abbreviated length, whereas, the securing of said knob at a lower position results in a tape segment of greater length.

The tape is dispensed from the tape roll 6 by depressing the lever arm downwardly within the pathway 7 until it comes into contact with the stop 8 as a result of which the tape drum is caused to rotate and feed onto the fluted surface of the feed wheel 5 a tape segment of predetermined length (FIGS. 1 and 4). This tape segment is severed by lifting the tape end upwardly from the feed wheel and bringing same into contact with the cutting edge of the straight-edged blade 41 with a sidewise motion. This blade severs the tape cleanly and without the frayed edges which characterize tapes cut with corrugated blades.

A new blade is inserted into the dispenser by impressing one end of the blade 40 into the bevelled opening 42 in a slidable manner and this sliding engagement is maintained until the blade is centered within cavity 41. This procedure will also serve to replace a used blade because it simultaneously ejects the former from an opposite end opening as the new blade is centered. Once the new blade has been inserted only the center or cutting segment of the blade is exposed and this segment is recessed within the indentation shown generally as 43 in FIGS. 2 and 3. Within this indentation or recess the blade extends downwardly in a vertical mode so that its cutting edge lies immediately above the tape segment on a plane which intersects the path of said wheel. The terminii or ends of the blade are not exposed and they are shielded instead by projecting segments 44 and 45 so as to protect the user from the injuries which can result from inadvertent contact.

This invention has been described by reference to precise embodiments but it will be appreciated by those skilled in the art that this invention is subject to variation and modification and to the extent that these would be obvious to one of ordinary skill they are considered as being within the scope of the appended claims.

What is claimed is:

1. An apparatus for dispensing predetermined lengths of tape which comprises:

(1) a framed housing in which there is disposed a revolving tape drum for supporting a tape roll;

(2) a feeder wheel onto which said tape is dispensed;

(3) a lever arm for rotating said feeder wheel through a succession of sequenced movements so as to feed said tape incrementally onto the peripheral surface of said wheel;

(4) a cover assembly slidably engaged within grooved openings in said housing above said feed wheel, said assembly terminating in a vertical segment which includes a slotted aperture having two end openings for receiving a straight-edged blade; and (5) a straight-edged blade slidingly engaged within said aperture to provide tape cutting means.

2. The apparatus according to claim 1 wherein said blade is on a plane which intersects the circular path of said wheel.

3. The apparatus according to claim 1 wherein said cover assembly consists essentially of a flat elongate cowling to which the vertical segment is joined by an angular segment.

4. The apparatus according to claim 1 wherein said angular segment lies at an angle of about 45° with respect to said elongate section.

5. The apparatus according to claim 1 wherein said vertical segment consists essentially of a generally U-shaped member into which said blade is slidingly inserted.

6. The apparatus according to claim 5 wherein said U-shaped member includes a recessed cutout for exposing a section of the cutting edge of said blade.

7. The apparatus according to claim 6 wherein the ends of said U-shaped member, adjacent to said cutout, cover the terminii of the blade to protect against injurious contact.

8. The apparatus according to claim 1 wherein said slotted aperture includes bevelled openings to enhance the insertion of said blade.

* * * * *